US007311212B2

(12) United States Patent
Martin et al.

(10) Patent No.: US 7,311,212 B2
(45) Date of Patent: Dec. 25, 2007

(54) DISPLAY SYSTEM

(75) Inventors: Arthur R. Martin, Westport, CT (US); Christopher S. Anderson, Westport, CT (US); Keith G. Arndt, New York, NY (US); Anthony C. Squitieri, Monroe, CT (US)

(73) Assignee: Mechtronics Corporation, White Plains, NY (US)

( * ) Notice: Subject to any disclaimer, the term of this patent is extended or adjusted under 35 U.S.C. 154(b) by 151 days.

(21) Appl. No.: 10/480,085

(22) PCT Filed: Jun. 10, 2002

(86) PCT No.: PCT/US02/19169

§ 371 (c)(1),
(2), (4) Date: Nov. 22, 2004

(87) PCT Pub. No.: WO02/101692

PCT Pub. Date: Dec. 19, 2002

(65) Prior Publication Data

US 2005/0067362 A1 Mar. 31, 2005

Related U.S. Application Data

(60) Provisional application No. 60/297,067, filed on Jun. 8, 2001, provisional application No. 60/313,717, filed on Aug. 20, 2001.

(51) Int. Cl.
*A47B 43/00* (2006.01)

(52) U.S. Cl. ..... 211/189; 211/91.01; 211/150; 211/184

(58) Field of Classification Search ..... 211/4, 211/7, 57.1, 59.1, 59.4, 87.01, 103, 88.01, 211/134, 90.01, 149, 90.02, 150, 90.03, 170, 211/175, 181.1, 184, 187, 188, 189, 192, 211/207; 40/642.01; 312/128, 133, 135; 108/6, 60, 61, 93–96, 106–108, 147.11; 248/220.21, 248/235, 220.31, 241, 220.41, 247, 220.42, 248/220.43, 221.11, 221.12, 222.51, 222.52, 248/225.21, 242
See application file for complete search history.

(56) References Cited

U.S. PATENT DOCUMENTS

| | | | | | |
|---|---|---|---|---|---|
| 2,218,444 | A | | 10/1940 | Vineyard | 211/49 D |
| 2,572,090 | A | | 10/1951 | Allen | 211/184 |
| 3,535,939 | A | * | 10/1970 | Dobbs et al. | 251/62 |
| 3,640,389 | A | * | 2/1972 | Snyder | 211/187 |
| 3,934,727 | A | * | 1/1976 | Brefka | 211/7 |
| 4,205,763 | A | | 6/1980 | Merl | 221/173 |

(Continued)

*Primary Examiner*—Jennifer E. Novosad
(74) *Attorney, Agent, or Firm*—Wiggin and Dana LLP; Anthony P. Gangemi; Dale L. Carlson

(57) ABSTRACT

A display system can accommodate a number of products. The system includes one or more modules. Each module may be mounted on a support wall and includes back and shelf portions. Advantageously, a number of modules are arranged in a number of rows, one row above another. A number of dividers are removably secured to at least one of the walls and may be moved in stepwise or continuous fashion to separate groups of the products within each row. Various of the modules may include hook bars secured to the back wall portions for hanging certain of the products and/or space thieves removably secured to the shelf portions for forwardly offsetting stacked or hung products.

9 Claims, 11 Drawing Sheets

U.S. PATENT DOCUMENTS 4,328,902 A 5/1982 North ..... 220/23.4
4,416,380 A 11/1983 Flum ..... 211/49 D
4,454,949 A 6/1984 Flum ..... 211/49 D
D275,058 S 8/1984 Flum ..... D6/467
4,470,943 A 9/1984 Preis ..... 262/162
4,474,491 A 10/1984 Ferrarelli ..... 403/305
4,478,337 A 10/1984 Flum ..... 211/49 D
4,560,072 A * 12/1985 Burrell ..... 211/75
4,593,823 A 6/1986 Fershko et al. ..... 211/49.1
4,620,489 A * 11/1986 Albano ..... 108/105
D290,790 S 7/1987 Nathan et al. ..... D6/408
4,694,966 A 9/1987 Sorenson et al. ..... 211/88
4,801,025 A 1/1989 Flum et al. ..... 211/128
4,809,855 A 3/1989 Bustos ..... 211/59.2
4,925,037 A 5/1990 Holley, Jr. ..... 211/59.2
4,958,739 A 9/1990 Spamer ..... 211/153
4,997,094 A 3/1991 Spamer et al. ..... 211/153
5,024,336 A 6/1991 Spamer ..... 211/59.2
5,088,607 A * 2/1992 Risafi et al. ..... 211/59.3
5,119,945 A 6/1992 Wiggins ..... 211/59.2
5,190,186 A 3/1993 Yablans et al. ..... 221/124
5,240,126 A 8/1993 Foster et al. ..... 211/59.3
5,255,802 A * 10/1993 Krinke et al. ..... 211/184
5,265,738 A 11/1993 Yablans et al. ..... 211/59.3
5,269,447 A * 12/1993 Gower et al. ..... 224/542
5,351,838 A 10/1994 Flum ..... 211/59.2
5,450,968 A 9/1995 Bustos ..... 211/59.2
5,464,103 A * 11/1995 O'Brien ..... 211/133.3
5,526,944 A * 6/1996 Merl ..... 211/87.01
5,562,217 A 10/1996 Salveson et al. ..... 211/59.3
5,624,042 A 4/1997 Flum et al. ..... 211/59.2
5,634,564 A 6/1997 Spamer et al. ..... 211/59.3
5,645,176 A 7/1997 Jay ..... 211/59.2
5,673,801 A * 10/1997 Markson ..... 211/59.3
5,685,664 A 11/1997 Parham et al. ..... 403/393
5,788,091 A 8/1998 Robertson et al. ..... 211/59.2
D401,436 S 11/1998 Jay ..... D6/408
5,833,077 A * 11/1998 Engel ..... 211/59.1
5,904,256 A 5/1999 Jay ..... 211/59.2
6,068,142 A 5/2000 Primiano ..... 211/183
6,082,556 A 7/2000 Primiano et al. ..... 211/59.2
6,082,558 A 7/2000 Battaglia ..... 211/59.3
6,129,218 A 10/2000 Henry et al. ..... 211/59.3
6,142,316 A 11/2000 Harbour et al. ..... 211/59.2
6,164,462 A 12/2000 Mumford ..... 211/59.2
6,234,328 B1 5/2001 Mason ..... 211/90.02
6,237,784 B1 5/2001 Primiano ..... 211/59.2
6,276,538 B1 8/2001 Battaglia et al. ..... 211/59.2
6,325,221 B2 12/2001 Parham ..... 211/59.2
6,513,667 B2 2/2003 Battaglia et al. ..... 211/59.2
6,523,702 B1 2/2003 Primiano et al. ..... 211/59.2
2001/0002658 A1 6/2001 Parham ..... 211/59.2
2001/0020604 A1 9/2001 Battaglia et al. ..... 211/59.2
2002/0027115 A1* 3/2002 Gay et al. ..... 211/187

* cited by examiner

DISPLAY SYSTEM

CROSS-REFERENCE TO RELATED APPLICATIONS

This patent application is the U.S. national phase of International Patent Application Ser. No. PCT/US02/19169, entitled "Display System", that was filed on Jun. 10, 2002 and published in English on Dec. 19, 2002 as International Publication No. WO 02/101692, and claims priority of U.S. Provisional Patent Applications Ser. No. 60/297,067 and Ser. No. 60/313,717 entitled "Display System" and "Tray Support System" filed on Jun. 8, 2001 and Aug. 20, 2001, respectively, the disclosures of which are incorporated by reference in their entireties.

BACKGROUND OF THE INVENTION (1) Field of the Invention

This invention relates to displays, and more particularly to displays mountable on vertical support surfaces such as pegboard walls and in-store shelving gondolas.

(2) Description of the Related Art

A wide variety of systems exist for displaying goods in the retail environment. Many such systems are used to display many small product packages. These various systems make use of many product holding means including hooks, trays, chutes, and the like. Some displays are freestanding while others are mounted to a support structure such as a shelving gondola. Common gondola configurations feature long rows of shelving facing aisles on either side of the gondola. At the gondola's ends, additional shelving or other display areas define end caps. One common auxiliary display system is known as the power wing, typically secured at the side of an end cap and protruding slightly into the adjacent aisle. Smaller displays may be secured to the sides of the power wing and may face the longitudinal direction of the aisle. Such smaller displays are often identified as mini wings. Mini wing-type displays may also be mounted to shelving fronts to protrude into an aisle. These may include portions facing the aisle or facing the longitudinal direction of the aisle.

BRIEF SUMMARY OF INVENTION

A display system can accommodate a number of products. The system includes a display module having a back portion and a shelf or bottom portion, preferably hinged relative to each other. The modules are preferably hangable, and are preferably mounted on a vertical support surface such as a gondola pegboard wall. The modules may be arrayed in one or more rows.

The products may be supported by the shelves individually or stacked on the shelves and may be in trays and/or may be suspended from hooks mounted to the module back. Space thieves may forwardly offset product relative to the module back. Dividers may be provided to separate groups of products. Mounting features may provide stepwise or continuous transverse positioning of the dividers, hooks, space thieves and other elements such as signage. Longitudinal adjustment is particularly advantageous for the space thieves.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
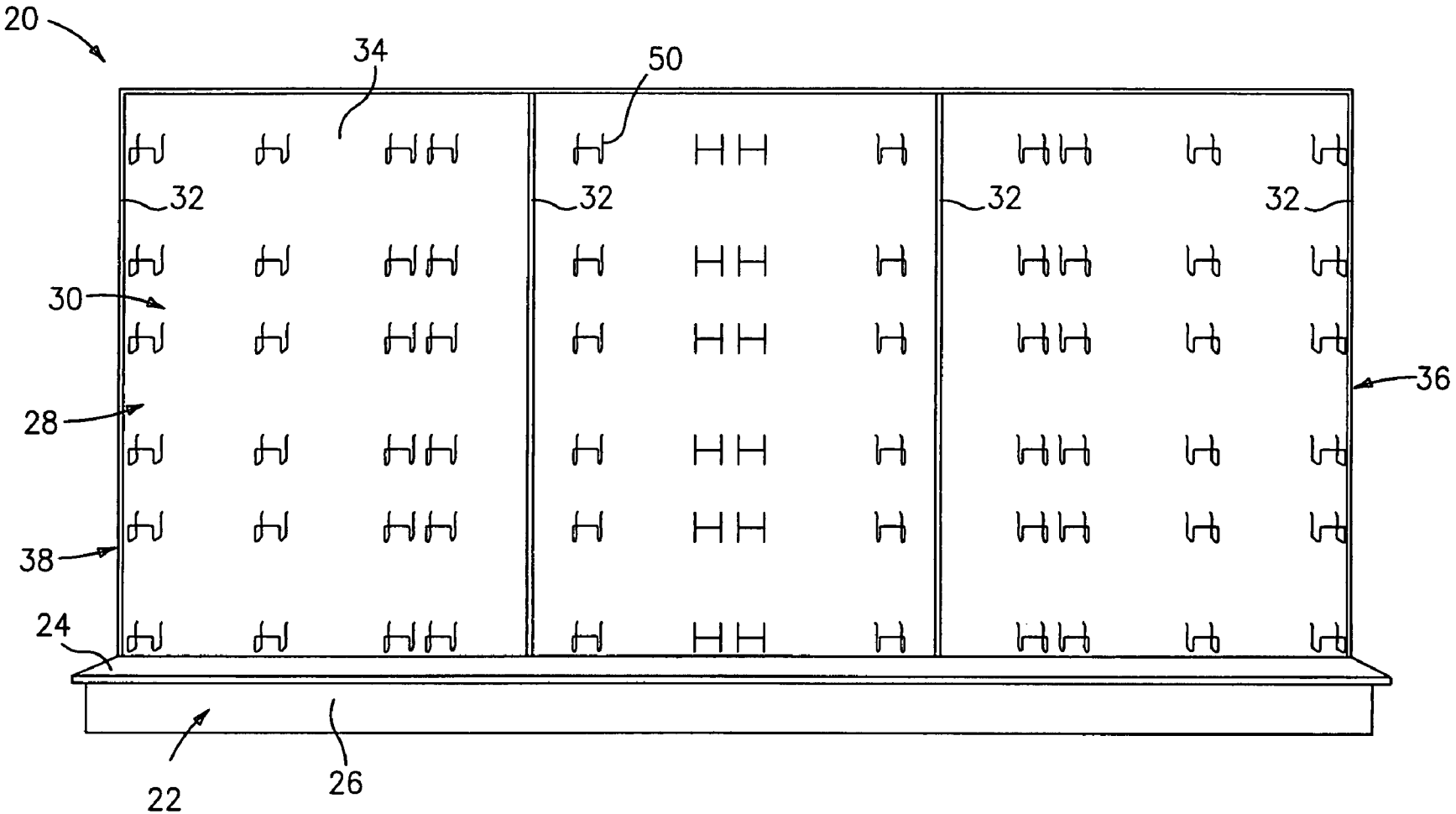
FIG. 1 is a view of a gondola unit.

FIG. 1 shows an exemplary shelving gondola 20. The gondola has a base 22 with an upper surface 24, a front 26 and a lower surface for supporting the gondola on a floor surface. The gondola further includes a wall 28 extending upward from a back portion of the base. The wall includes pegboard 30 having an array of through-holes (e.g., a square array one inch (2.5 cm) on center). A series of standards 32 may extend along a front surface 34 of the pegboard to provide structural support. Exemplary standards are square-sectioned steel tubing (e.g., one to two inches or two to five cm). An exemplary gondola is approximately twelve feet (four m) in width from left to right ends 36 and 38 (as viewed from the point of view of the gondola rather than a user facing the gondola). The exemplary gondola has a height of about six feet (two m) with at least about 4.5 feet (1.5 m) being the pegboard wall. The gondola may be formed in multiple sections.

Figure 2:
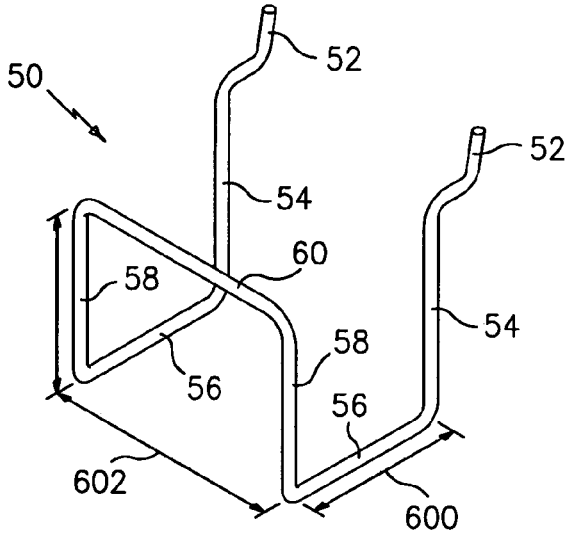
FIG. 2 is a view of a hanger that may be mounted to the gondola of FIG. 1.

As heretofore described, the gondola may be similar to any number of prior art configurations. FIG. 1, however, shows a number of mounting brackets 50 for one exemplary embodiment of a display system according to the present invention. The exemplary mounting brackets are in the form of bent steel wire hangers or hooks. Each hanger (FIG. 2) has two end portions 52 bent to engage the pegboard wall through a pair of holes therein in conventional fashion. A somewhat modified version could be provided for slatwall mounting. A rear portion of the hanger is formed by two lengths 54 vertically depending from the associated end portions 52 along the front surface 34 of the wall. From the bottom of these lengths 54, lengths 56 extend forward and therefrom lengths 58 extend upward and are joined by a coplanar transverse central length 60. The length 56 defines a bottom portion of the hanger and the lengths 58 and 60 define a front portion of the hanger. The forward 600 offset provided by the lengths 54 and the transverse span 602 provided by the length 60 permit the hanger to span one of the standards 32 if the desired display arrangement requires positioning of a hanger at such a location.

Figure 3:
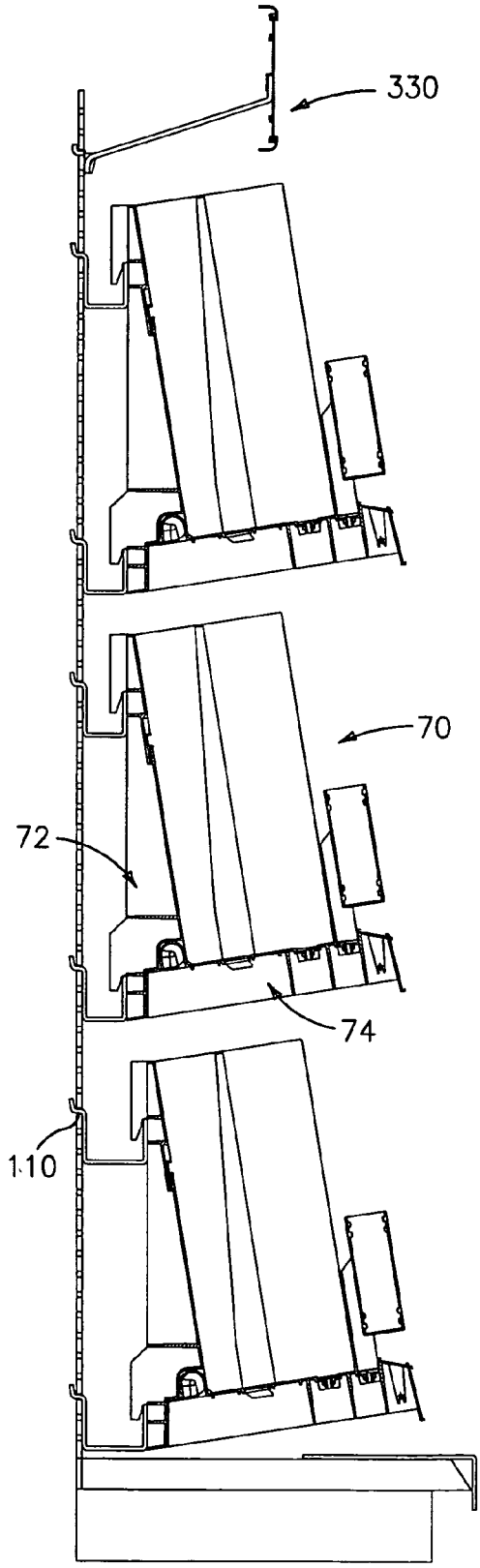
FIG. 3 is a partial side sectional view of a gondola carrying display modules according to principles of the invention.

In the exemplary embodiment, an adjacent group of six (three upper and three lower) hangers support each individual display module. FIG. 3 shows a module 70 having a back portion 72 hinged relative to a shelf or base/bottom portion 74. The back and shelf portions may each consist principally of a one-piece molding (e.g., injection molded medium impact polystyrene (MIPS)). The back and shelf portions are coupled via a hinge structure comprising a plurality of intermeshed channels integrally formed with the back and shelf and a separate hinge pin or axle 76 (FIG. 4) (e.g., of 0.25 inch diameter steel wire) extending therethrough to define an axis of rotation 508. The back portion 72 has a generally forward facing front side 80 and a generally rearward facing rear side 82. A principal portion of the front side may lie along a front plane 510. Advantageously, in the installed condition the plane 510 is between truly vertical and about 20° declined. A preferred orientation is no more than 10° and no less than 5° (e.g., 9°). The portion along such plane may be identified as a frontal wall portion 83. The shelf portion 74 is hingeable relative to the back portion 72 through a range of orientations between a stowed orientation (FIG. 5) in which a first surface 84 of the shelf portion is in close facing relationship to the side 80 and a fully deployed orientation (FIG. 4) where the surface 84 is an upper surface (relative to the back portion 72 in its generally vertical orientation). A principal portion of the surface 84 may be along a plane 512. The plane 512 is advantageously similarly declined relative to horizontal and is perfectly orthogonal to the plane 510. At a forward edge of the shelf portion, a lip structure 90 having back, top and front surfaces 92, 94 and 96 extends upward from the plane 512.

Figure 6:
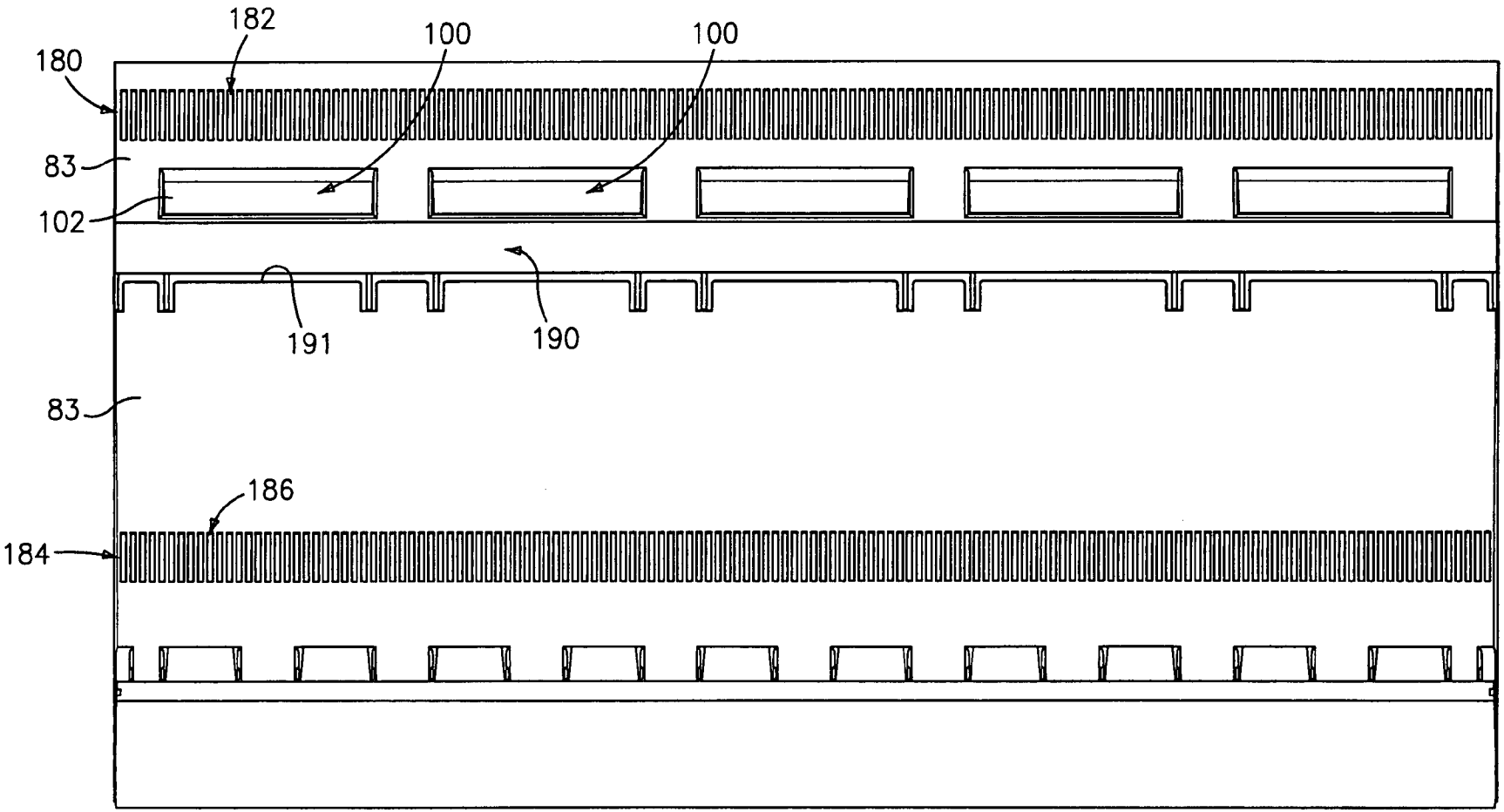
FIG. 6 is a front view of a display module.

The back portion 72 is provided with a plurality of apertures 100 (FIG. 6), from the top of each of which depends a short web 102. The web 102 may be received by channels 104 (FIG. 4) in each of the hangers defined between the front, rear, and bottom portions of the hangers. The end portions 52 serve as a pair of prongs for engagement of mounting apertures 110 (FIG. 3) provided by the through-holes in the pegboard 30. For ease of mounting, the front surface of the web 102 maybe inclined to converge forward (FIG. 4) to trap the first portion of the associated hanger. This allows a user to easily, and without initially precise aim, hang the module from the pegboard with the incline guiding the module into a precise registry. The offset provided by the lengths 54 may be effective to forwardly offset a rear extremity 116 of the back portion from the front surface 34 of the pegboard so that the back portion may straddle any vertical standard 32 along the gondola wall. The webs 102 and associated rearward projections they front can alternatively be used to mount the module to other mounting features such as rods (not shown) extending transversely between support posts (not shown).

An exemplary module is approximately three feet (1 m) in width between left and right sides. To maintain alignment of rows, adjacent back and/or shelf portions may be secured to each other such as by the fastening of screws and wing nuts through holes in adjacent pairs of sidewalls of such back and/or shelf portions. For example, holes 120 may be provided in the sidewalls of the shelf portions and the screws conveniently put therethrough with all shelf portions of a given row in their stowed orientation whereupon the shelf portions may be rotated as a unit to their deployed orientations.

FIG. 3 shows an exemplary installation in which there are three rows of modules one above the other mounted to the pegboard wall. Advantageously, at least the upper two rows are similarly formed and positioned. Although the lowest row may also be similarly formed, in various embodiments at least the front edge of the shelves of the bottom row of modules may be forwardly offset relative to the front edges of the other rows. This offset maybe achieved in a number of ways. For example: the shelf may be deeper; the hangers may have a greater offset (as shown in FIG. 3); or the modules' shelves may simply be supported atop the gondola base in a forwardly offset condition. This forward offset provides convenient access to products held by the lowest row. Also, particularly the lower row may be formed of modules having relatively short back portions.

Figure 7:
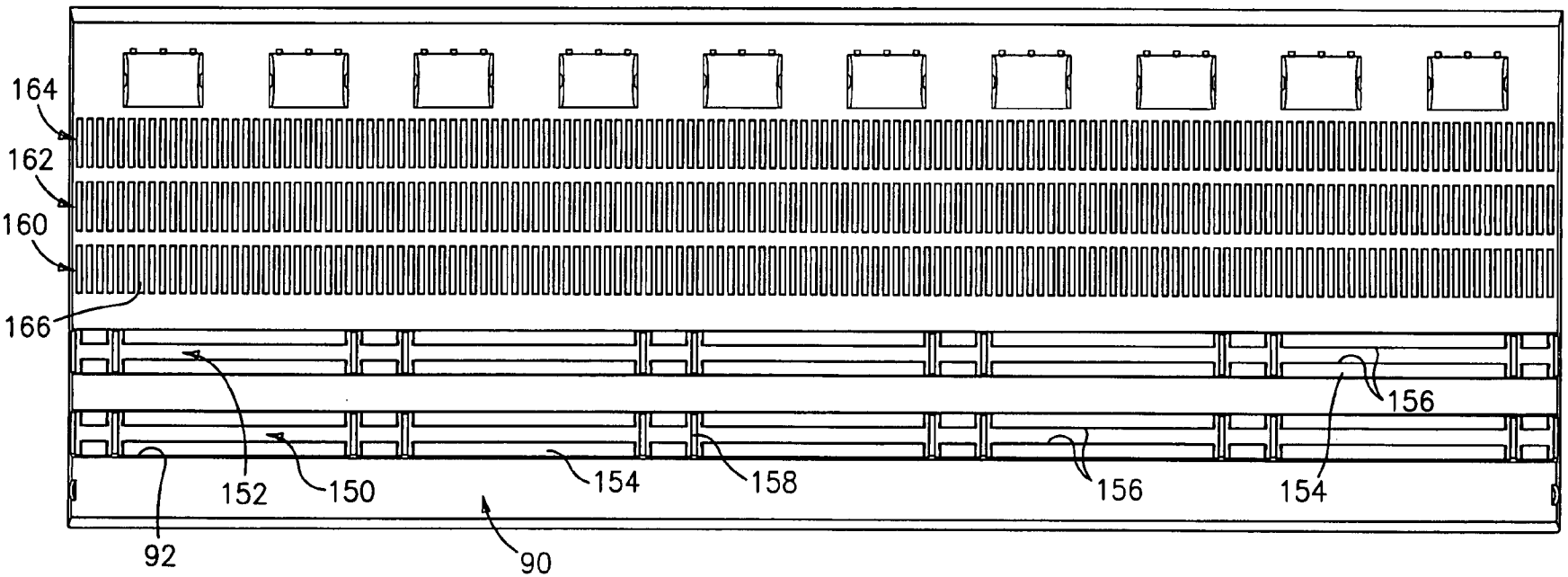
FIG. 7 is a top view of a shelf portion of the module of FIG. 6.

The individual modules may be provided with a number of mounting features for removably securing a variety of product holding and positioning components, signage holding components, and the like. The exemplary embodiment includes such features on both the shelf and back portions. The shelf portion is molded having a generally flat upper surface to the rear of the back surface 92 of the front edge lip 90. A first pair of features are transverse slots 150 and 152 (FIG. 7) extending the width of the shelf and having shoulders 154 rebated below the plane 512 with depending walls 156. The first (front) slot 150 is just behind the lip back wall 92. The second (rear) slot 152 is slightly behind the first. Although the slots are continuous, the shoulders are interrupted at longitudinal structural support webs 158 as a molding artifact. Behind the second slot are three rows 160, 162, and 164 of fine pitch front-to-back apertures 166.

Near the upper edge of the back portion is a transverse row 180 (FIG. 6) of fine pitch vertical apertures 182 in the frontal wall portion 83. A substantially identical row 184 of apertures 186 is near the bottom of the frontal wall potion 83 above the hinge structure. Relatively low on the upper half of the back portion is a channel 190 which leaves an exposed upwardly facing edge 191 of the frontal wall portion 83 behind the plane 510.

Figure 4:
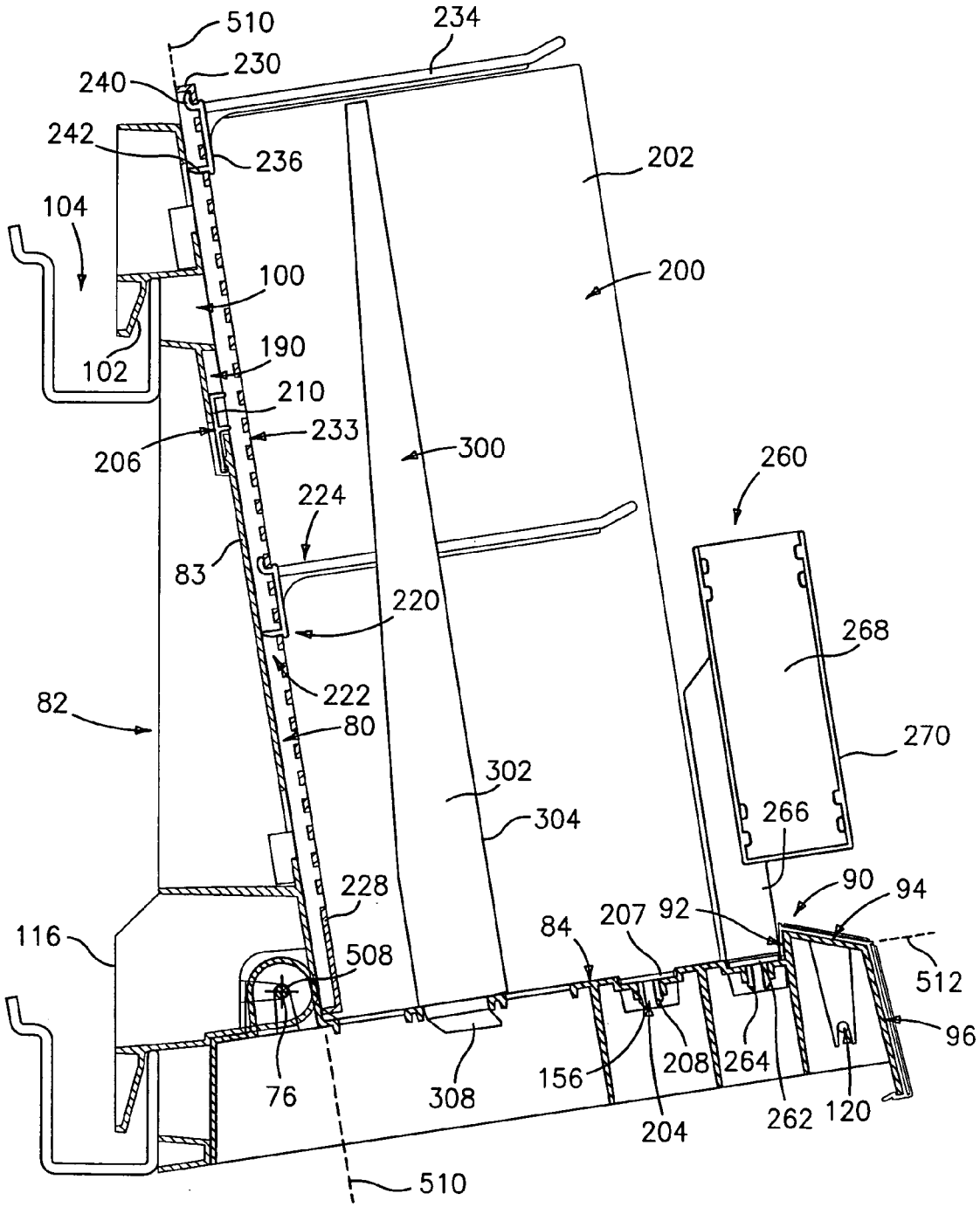
FIG. 4 is a partial side sectional view of a display module of FIG. 3.
Figure 5:
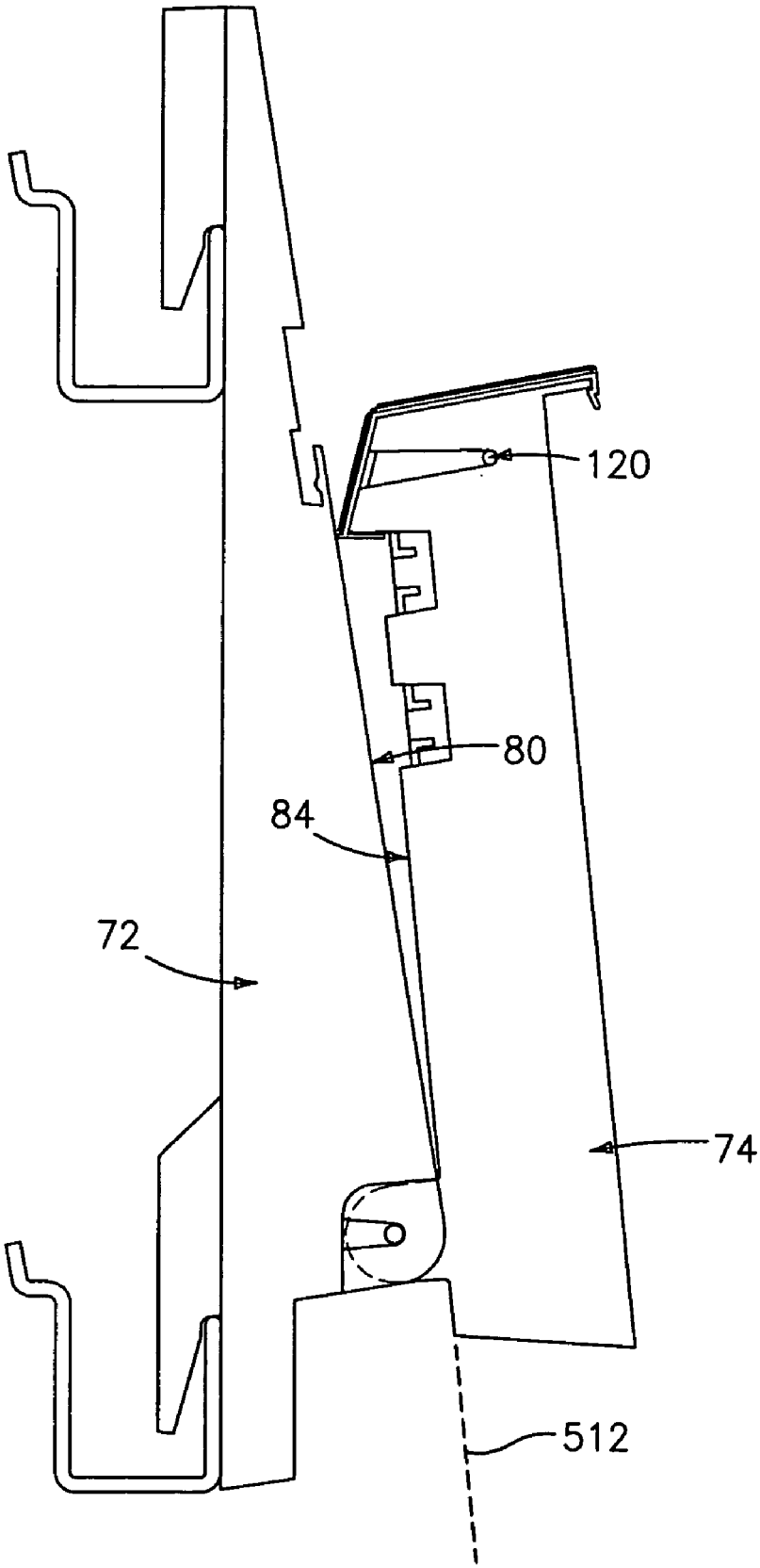
FIG. 5 is a side view of a display module in a stowed condition.
Figure 8:
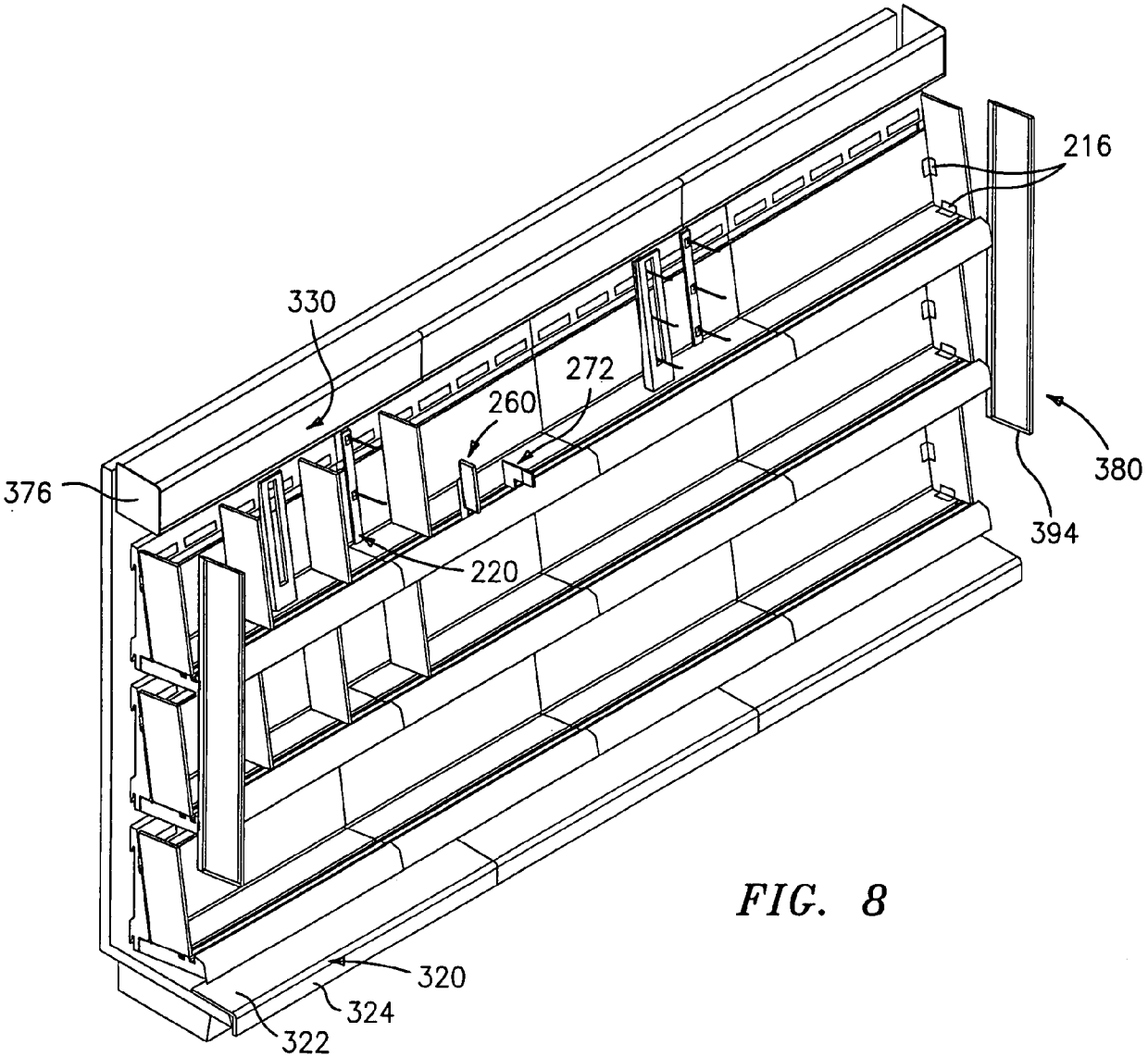
FIG. 8 is a view of a gondola with installed modules and accessories according to principles of the invention.

One accessory is a divider wall 200 (FIG. 4). The exemplary divider wall structurally consists essentially of a unitary plastic molding (e.g., of MIPS). The molding includes a generally rectangular web 202 and mounting features 204 and 206 for engaging associated ones of the module mounting features. The exemplary divider includes two such mounting features. The first mounting feature 204 is formed along the lower edge of the web 202 relatively close to the front edge thereof This mounting feature has a transverse foot or base plate portion 207 from which a pair of front and rear barbed projections 208 depend. The exemplary projections are transversely-elongate with a vertical rail depending from the base plate portion and a foot serving as the barb. The base plate portion 207 has a height and depth effective to be accommodated within the rebate defined by the shoulders of the rear slot 152 so as to be essentially flush or subflush to the shelf upper surface plane 512. The projections 208 have sufficient height so that their barbs can engage the lower edges of the walls 156 at respective front and rear sides of the slot 152. Along the back edge of the web 202, relatively high thereon, a transverse plate 210 is formed connected to the web adjacent its upper end 212. A lower end 214 depends from the connection. The divider may be assembled to the module by first locating the plate 210 in the channel 190 at which point the base plate 206 and its associated projections 208 are above the slot 152. The divider is then shifted downward bringing the lower end 214 of the plate 210 behind the frontal wall portion 83 and bringing the barbed projections 208 into engagement with the slot depending walls 156. Further lowering of the divider compresses the projections 208 permitting the barbed portions to pass through the slot 152 ultimately releasing as the barbs pass below the associated walls 156. In this installed condition, the divider may be transversely slid along the module and may even be slid over the interface between two modules to a desired position. Advantageously, two versions of the divider may be provided. In a first version, the mounting features extend substantially only to the left of the web and in a second, substantially only to the right. This permits one of the first dividers to be located with its web at the extreme right of a row of modules and one of the second to be located with its web at the extreme left of the row. When used at intermediate locations, either may be appropriate. When used at the extreme end (or any other situation in which sliding is particularly undesirable), a locking means may be provided. A simple mechanism is to adhere a pair of angle brackets 216 (FIG. 8) to the divider web and the adjacent frontal wall portion 83 and shelf upper surface. Alternate securing means may utilize the various rows of apertures in the back and shelf portions. A relatively deep divider (not shown) might have a web extending further forward. If extending over the front slot 150, the dividers otherwise similar mounting feature could engage that slot. This might be particularly useful if the divider carries signage intended to extend forward of the products carried by the module.

Figure 9:
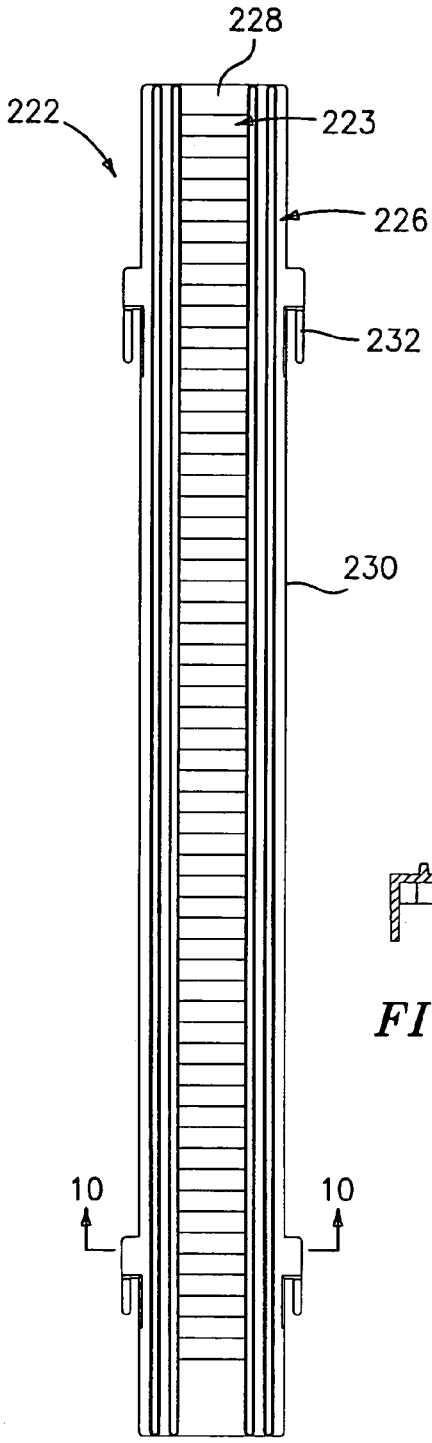
FIG. 9 is a front view of a hook mounting fixture according to principles of the invention.
Figure 10:
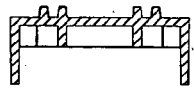
FIG. 10 is a horizontal sectional view of the fixture of FIG. 9, taken along line 10-10.

The rows of 180 and 184 apertures may be used for mounting peg hook units. An exemplary hook unit 220 (FIG. 4) consists essentially of the assembly of a separate hook mounting fixture 222 and hooks 224, allowing a desired number of hooks to be positioned at desired vertical locations along the fixture 222. The exemplary fixture 222 is formed as a unitary molding having a generally rearwardly-open box-like body portion 226 (FIGS. 9 and 10) having a forward central web 228 circumscribed by a sidewall 230 and a number of claws 232 extending rearwardly therefrom for engaging the apertures 182 and 186. In the exemplary embodiment, the body 226 has left and right upper and left and right lower claws for engaging respective pairs of apertures 182 and 186 in the upper and lower rows 180 and 184. The claws project rearward and downward allowing the fixture to be installed by inserting the claws with a rearward motion into the associated apertures and shifting the fixture downward so that the depending portions of the claws catch against the rear surface of the frontal wall portion 83. The fixture 222 has a vertical row of transversely-extending slots 223 for receiving the hooks 224.

The exemplary hooks 224 (FIG. 4) are formed as unitary moldings having a shaft 234 extending forward from a distal root portion at a base plate 236. The exemplary shaft has a generally straight section terminating in a more upwardly-directed portion at its distal end. Near the upper edge of the rear of the hook base plate 236, a transversely-elongate, upwardly-directed, first finger 240 extends rearward. Near the lower edge, a transversely-elongate, barbed, second finger 242 with a downwardly-directed barb extends rearward. The hook 224 may be engaged to the fixture 222 by holding the hook in a declined orientation allowing the upper finger 240 to be inserted through one of the apertures 233 so that the finger engages the back of the portion of the fixture web 228 immediately above the aperture. The hook is then rotated downward so that the lower finger passes into a lower aperture 233 with engagement between the finger 242 and web 228 below the lower aperture bending the finger upward until the barb has passed therethrough to catch against the rear surface of the web. Multiple hooks may be installed in this way. Exemplary material for the fixture and hooks is 15° glass filled nylon.

Figure 13:
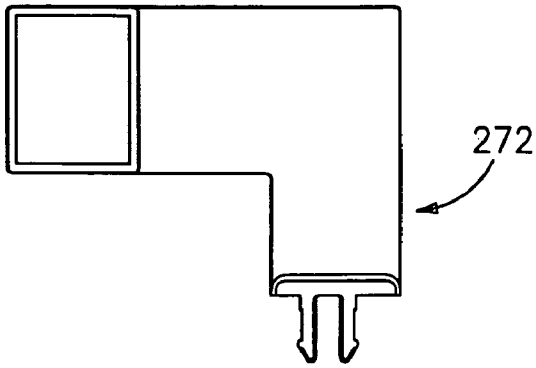
FIG. 13 is a side view of a second signage carrier according to principles of the invention.
Figure 14:
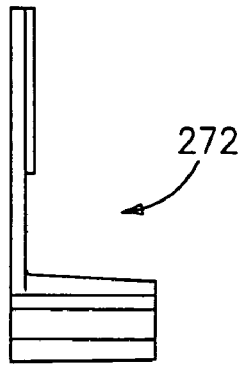
FIG. 14 is a front view of the signage carrier of FIG. 13.

In an exemplary embodiment, the front slot 150 may be used for mounting signage holders. An exemplary signage holder 260 has a base plate 262 and projections 264 similar to those of the divider. A trunk web 266 extends upward from one side of the base plate. An elongate, vertically-extending, rectangular signage-carrying web 268 circumscribed on front, bottom and back edges by a rim 270 extends upward and forward from the trunk web. On either side of the web, inward projections from the rim are provided to capture a signage card along the adjacent surface of the web. The projections are aligned with apertures in the web as an artifact of molding. Exemplary material for the signage holder 260 is injection molded high density polypropylene (HDPE). As with the dividers, there may be left and right handed versions for convenience of location. An alternate signage carrier is a card holder 272 (FIGS. 13 and 14). This may be generally similarly formed to the signage holder 260. However, the card holder may be relatively short and have a small mounting web in place of the signage-carrying web. To the mounting web, a conventional coextruded clear card gripper (not shown) may be mounted. An exemplary gripper is available from Fasteners for Retail, Inc. of Cleveland, Ohio as part 2112381802 and is mounted to grip a rear edge portion of the card so that the principal portion of the card can extend freely forward of the holder.

Figure 15:
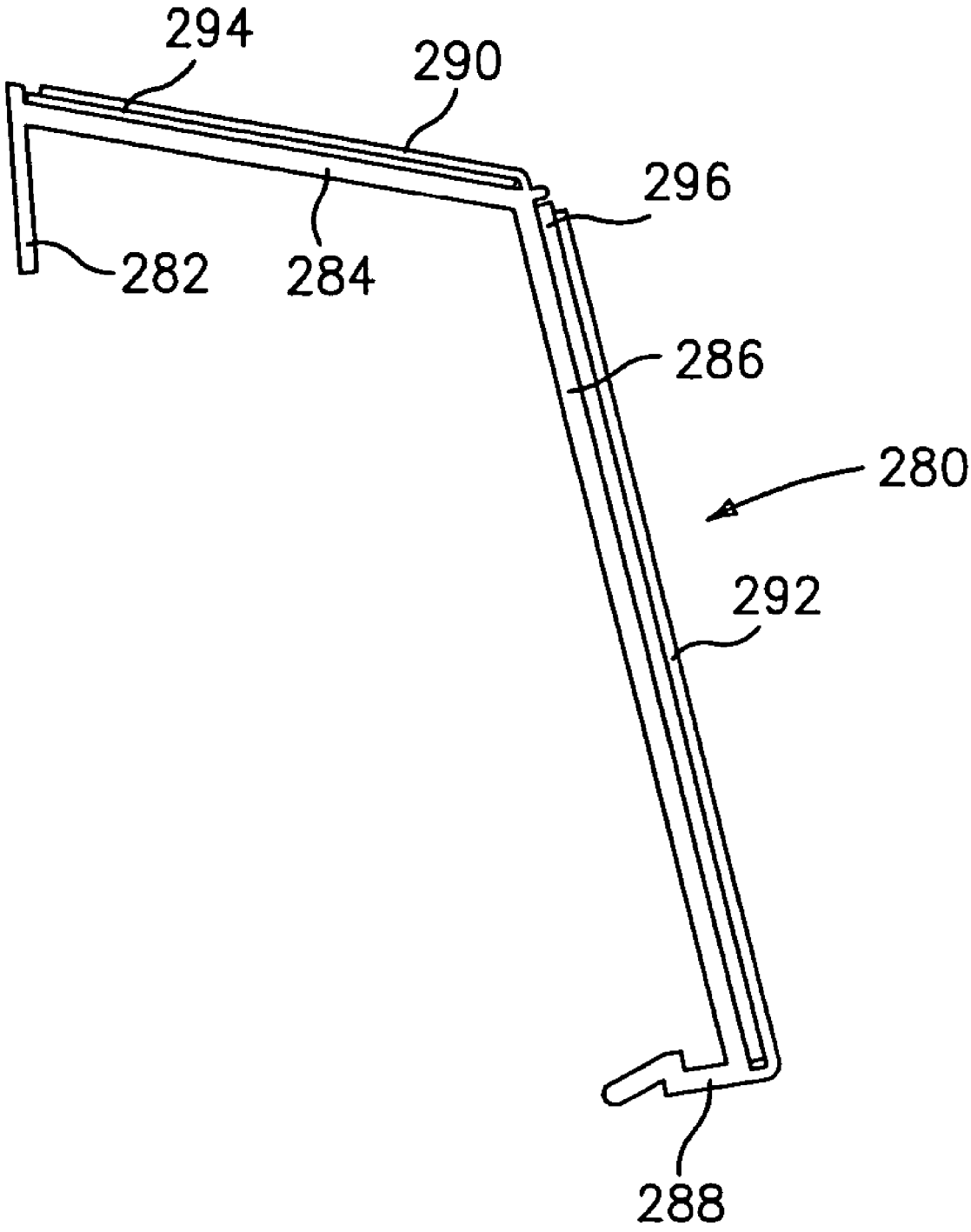
FIG. 15 is an end view of a signage-carrying extrusion according to principles of the invention for mounting to a front of the shelf of the module of FIG. 4.

An at least partially transparent (e.g., of clear polyvinylchloride (PVC)) extruded signage carrier 280 (FIGS. 4 and 15) is provided for the front of each shelf. The extrusion has a first portion 282 for covering the back surface 92 of the lip, a second portion 284 extending forward and downward therefrom for covering the top surface 92 of the lip, and a third portion 286 extending downward and forward yet therefrom for covering the front surface 96 of the lip. A barbed projection 288 extends rearward from a lower edge of the third portion for grasping around the lower front edge of the lip. The extrusion is provided with first and second transparent portions 290 and 292 immediately front of the second and third portions and joined thereto at lower edges. Signage cards 294 and 296 may be inserted from above into pockets behind the transparent portions.

In one example of use, the signage holders 260 carry signage indicating product categories. The carriers 280 carry signage indicating the particular products and having associated information (e.g., UPC codes, price, etc.). The card holders 272 carry signage indicating sales or specials or other indicia for attracting a customer's attention to a particular product.

Figure 16:
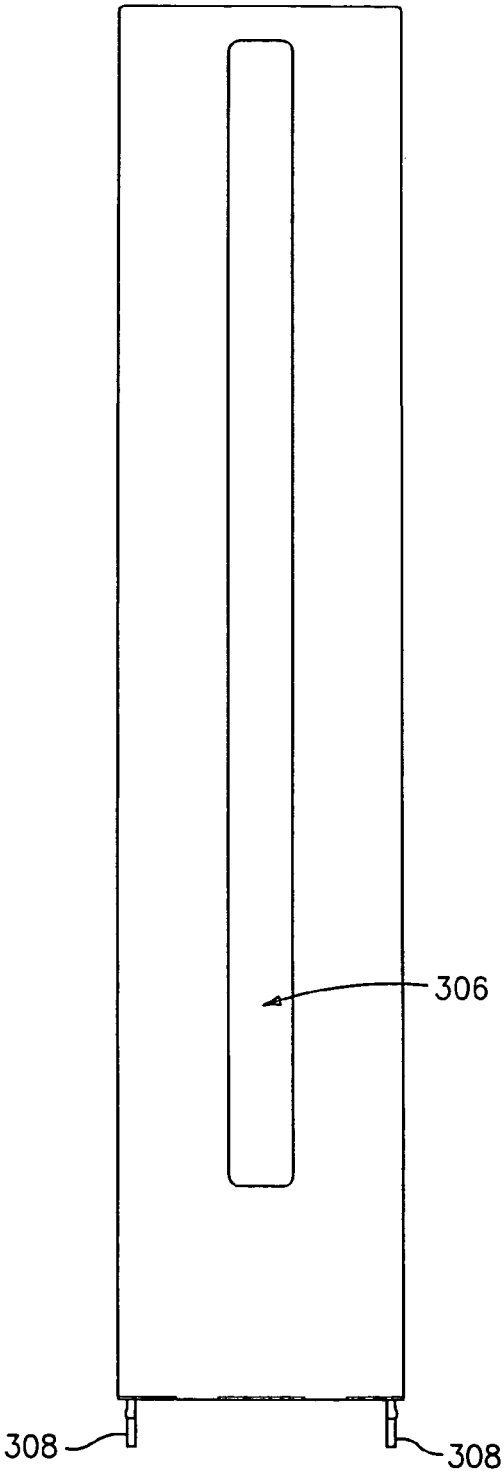
FIG. 16 is a front view of a space thief according to principles of invention.

Another product-positioning accessory is a space thief 300 (FIGS. 4 and 16). An exemplary space thief 300 is formed as a unitary molding (e.g., of MIPS) having a rearwardly-open, box-like, body 302 with a front surface 304. The exemplary front surface is a central, vertically-extending, elongate aperture 306. A pair of mounting projections 308 depend from the bottom of the body. The exemplary projections 308 are dimensioned to be accommodated in pairs of the apertures 166 in any given one of the rows 160, 162, and 164. Forward edges of the projections (FIG. 4) depend forward from a root portion of the projection permitting the forward edges to capture a portion of the shelf immediately ahead of the apertures in which they are received. This inclination allows the space thief to be rotated rearward into an installed condition and prevents it from being rotated beyond the installed condition. The exemplary installed condition places the surface 304 parallel to the plane 510 and perpendicular to a plane 512. The aperture 306 may permit one or more of the hooks 224 to pass through the space thief permitting the space thief to forwardly offset products carried by such hooks in desired increments ahead of the front surface of the book mounting fixture 222. The space thief may alternatively be used with free-standing product or stacked product (including product in trays). The use of the space thief permits a relatively small amount of product to occupy a given frontage. This may be desirable to permit a relatively slow-selling product to occupy a relatively large frontage without the need for a disproportionate inventory. The space thief may also be used to simply even up the front-to-back positioning of products having substantially differing depths.

When assembled to the gondola in such rows, the modules may form part of a larger display system including additional features. Among many possible features are a trim cover 320 (FIG 8) for concealing at least a front edge portion of the gondola base. The trim cover may be formed having an L-shaped cross-section with the longer portion or leg 322 extending rearward along the upper surface of the gondola base and the shorter portion or foot 324 depending therefrom in front of the front edge of the base. The underside of the leg of the cover may be provided with adhesive (e.g., initially with peel-off protective sheets) for securing it to the upper surface of the gondola base.

Figure 17:
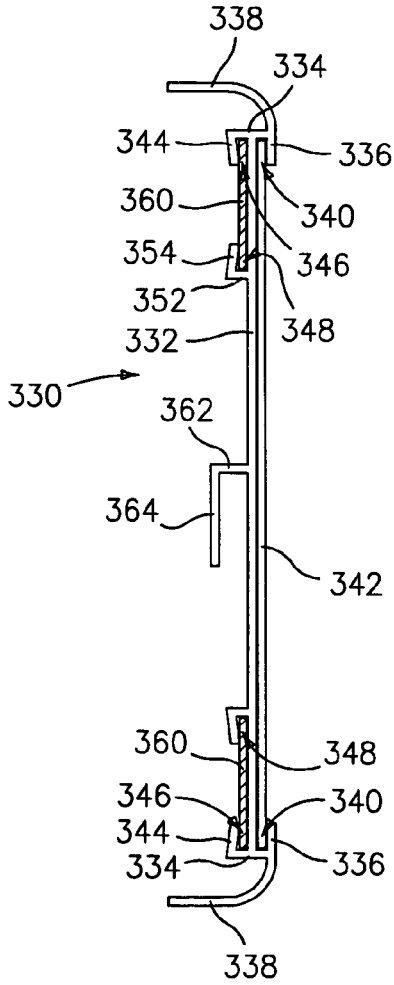
FIG. 17 is an end view of a header extrusion according to principles of the invention.

A signage-carrying header 330 (FIGS. 3 and 17) may also be provided, advantageously slightly above and forward of the top row of modules. An exemplary header is formed as extruded lengths (e.g., of MIPS) joined end-to-end. When viewed in an installed condition, the lengths have a central, generally vertical, web 332. At upper and lower edges of the web, when viewed in section, the extrusion has a short cross-member 334. A front of each cross-member joins the rear surface of one leg 336 of an angled section having a rounded corner, the remaining leg 338 being generally parallel to the cross-member 334 and spaced slightly apart therefrom. A short portion of each leg 336 extends in front of the web to create a pair of channels 340 for retaining upper and lower edge portions of a signage card 342. From the rear edge of each cross-member 334, another short wall 344 extends parallel to the web 332 spaced slightly apart therefrom to create a channel 346. Closer to the center of the web, opposite each of the two channels 346 a similar channel 348 is formed by the foot 352 and leg 354 of an L-sectioned portion extending rearward from the web 332. These create a pair of upper and lower slots for receiving plastic reinforcement plates 360 for spanning the joints between adjacent header sections. The plates may advantageously be secured to the sections by countersunk flat-head screws (not shown) extending rearward through the web with wing nuts (not shown) at the back surfaces of the plates.

For mounting the header, each section advantageously includes an inverted L-sectioned portion, the foot 362 of which merges with a central portion of the web back surface and the leg 364 of which depends parallel to and spaced slightly behind the web. The resulting channel can capture the distal portions of support brackets 370 (FIG. 3), the proximal portions 372 of which mate to the pegboard wall. Each exemplary support bracket proximal portion is formed by a molded plastic base and the distal portion is formed by the bent distal end portion of a wire, the proximal portion of which is mounted to the base. In installation, the base may first be mounted to the pegboard, then the wire member installed, followed by installation of the individual header sections, and, thereafter, by securing the sections to each other and inserting the graphic cards. Header end covers 376 (FIG. 8) may be secured to the exposed ends of the aligned header extrusions via a mounting bracket (not shown) having a pair of plate portions in place of the reinforcement plates 360.

Figure 18:
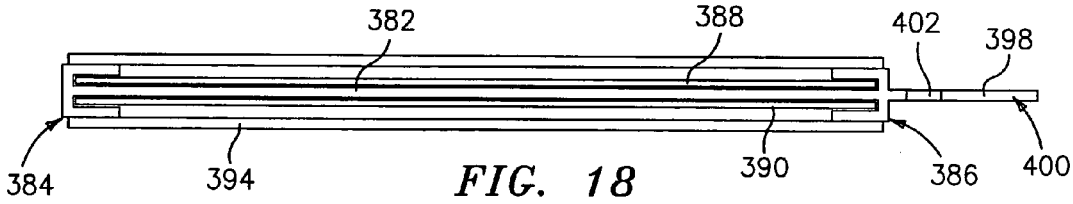
FIG. 18 is a top view of a blade sign according to principles of the invention.
Figure 11:
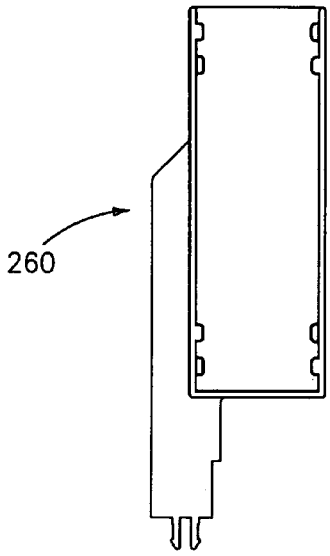
FIG. 11 is a side view of a first signage carrier according to principles of the invention.
Figure 12:
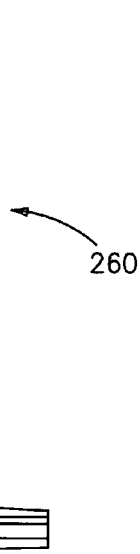
FIG. 12 is a front view of the signage carrier of FIG. 11.

At one or both ends of the rows of shelves there may be a vertically-extending blade sign 380 (FIG. 8) extending forward of the rows. An exemplary blade sign is formed as an extrusion having a principal web 382 (FIG. 18). The front edge of the web 382 merges with the interior of the base of a right, rearwardly-open, U-shaped channel 384. Slightly forward of the rear edge of the web, the base of a second forwardly-open, right U-shaped channel 386 intersects the web 382. The web 382 and channels 384 and 386 thus define individual channels for capturing front and rear edge portions of signage cards 388 and 390 along inboard and outboard surfaces of the web. The cards may be secured to the web via double sided adhesive tape (not shown) which may originally be applied to the blade side with an exposed removable sheet. Alternatively, or simultaneously, to support and retain the cards, a separate short U-shaped channel 394 (FIG. 8) may extend with the interior of its base along the lower edge of the blade sign extrusion. The side walls of the channel 394 may compressively engage the bottom ends of the exterior surfaces of the side walls of the channels 384 and 386 of the extrusion. Thus the channel 394 can support the cards 388 and 390 in the absence of adhesive.

A rear portion 398 of the web 382 behind the second U-shaped channel 386 may have one or more vertical arrays of mounting apertures 400. In an exemplary embodiment, a pair of metal mounting brackets (not shown) are respectively screwed to the exposed sides of the shelves of the outboard modules of the upper and middle rows of modules through the associated holes 110. The brackets are in turn screwed to adjacent mounting apertures 400 on the blade sign web. As a safety measure, the web may be provided with an integral hinge 402 between the mounting apertures and the second U-shaped channel. An exemplary hinge is formed by coextruding a relatively flexible material (e.g., TPE) with a relatively rigid material (e.g., HIPS) forming the remainder of the extrusion.

Figure 19:
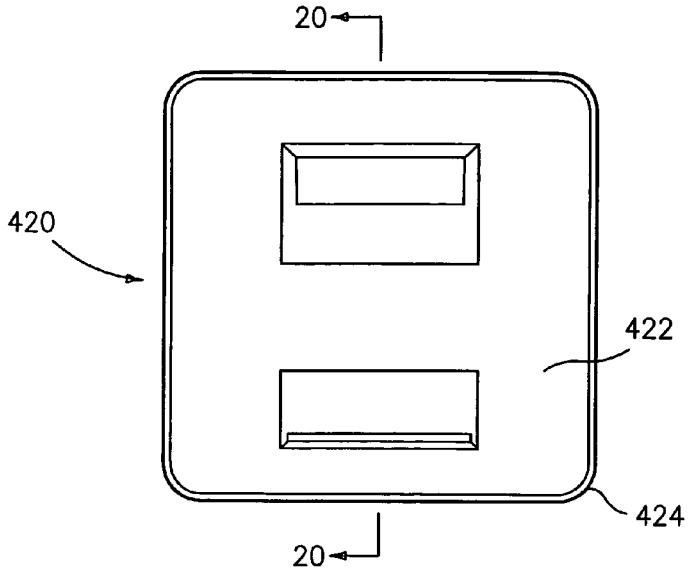
FIG. 19 is a front view of a third signage holder according to principles of invention.
Figure 20:
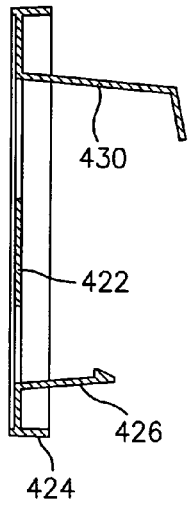
FIG. 20 is a side sectional view of the signage carrier of FIG. 19, taken along line 20-20.
Figure 21:
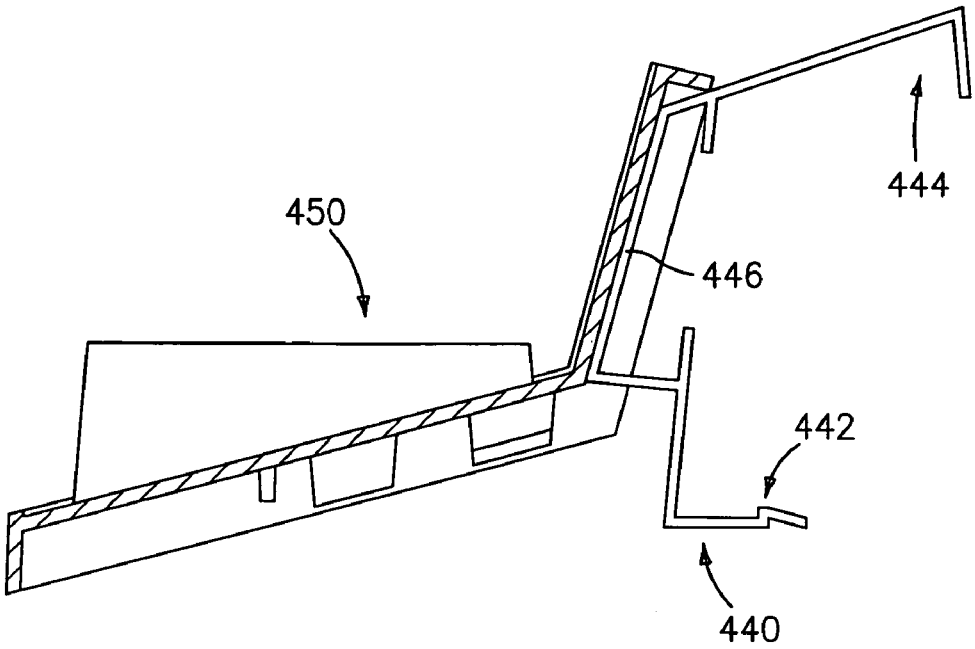
FIG. 21 is a partial sectional view of a sample carrier showing a mounting bracket according to principles of the invention in elevation.

A number of different accessories may be provided for grasping the fronts of the module shelf portions. One accessory is a sign holder 420 (FIGS. 19 and 20) for holding signage in a transversely-extending fashion, typically close to vertical if not actually vertical. An exemplary signage holder has a transverse web 422 circumscribed by a rim 424 extending slightly forward of the front surface of the web to conceal the edge of any signage card or the like and extending somewhat further behind the rear surface of the web for strength. A lower finger 428 extends rearward from a lower end of a lower aperture in the web and has a barbed end for grasping the underside of a front lip of the shelf (or the underside of the barbed projection 288, if present). An upper finger 430 extends rearward from the upper edge of an upper aperture and has a depending end portion for grasping the back surface of the lip (or of the extrusion first portion 282, if present). Sample holders, pad holders, and the like, may also be provided. These may use a common or similarly shaped bracket 440 (FIG. 21) which may be formed from an extrusion of appropriate length. An exemplary extrusion has portions 442 and 444 for grasping the front of a shelf and additional portions (e.g., 446) to which the relevant accessory 450 maybe attached.

The products displayed and vended by the system may be individual products or product multipacks and, may be the type of products otherwise hung from peg hooks. Exemplary products are photographic film, disposable cameras, and related goods. The products may originate from a single manufacturer or may originate from multiple manufacturers or other sources. Use of identical modules can present a continuous and harmonious appearance across an entire multi-manufacturer product category in a given retail environment. For trayed product, to the extent that the trays are of the type normally used for shipping the product, directly placing the open prepacked trays on the tray support saves the labor of individually removing the products and hanging them on hooks. For example, the trays may be corrugated cardboard boxes having an open top (e.g., a low-rise tray or a t least a tray with a low front wall, over which the products may easily be seen and grasped) or an open front (e.g., a five-sided tray from which the product does not protrude).

One or more embodiments of the present invention have been described. Nevertheless, it will be understood that various modifications may be made without departing from the spirit and scope of the invention. For example, various manufacturing techniques may be utilized and the system may be modified to suit particular product or environmental considerations and needs. Accordingly, other embodiments are within the scope of the following claims.

What is claimed is:

1. A device for supporting a plurality of products, said device comprising:

a back portion secured to a support surface in an installed condition and having front and back sides, left and right sides, and upper and lower ends;

a shelf portion hinged to a lower portion of the back portion for articulation between stowed and deployed conditions and having a first surface which is a substantially upper surface in said deployed condition and in close facing or contacting proximity to the back portion front side in said stowed condition; and a plurality of dividers, removeably secured to at least one of the back and shelf portions in said deployed condition, wherein each of the dividers include a base from which a pair of front and rear rails depend, the rails having a depending leg portion and a foot portion; and an upstanding web connected to the base;

wherein the shelf portion includes a first elongate transverse slot receiving the rails.

2. A device according to claim 1 further comprising:

a plurality of corrugated trays supported by the upper surface, at least some of the products being in a plurality of stacks, each tray containing at least one such stack.

3. A device according to claim 1, wherein the back portion is so secured to said support surface in said installed condition by:

a plurality of mounting brackets, each including a pair of mounting prongs and an upwardly open channel receiving an associated portion of the back portion.

4. A device according to claim 3 wherein:

the back portion has a plurality of apertures and said associated portions are at upper portions of said apertures.

5. A device according to claim 4 wherein:

there are at least three such apertures being left, right, and center such apertures and three such mounting brackets, engaging the upper portions of the left, right, and center apertures respectively.

6. A device according to claim 1 wherein the shelf portion upper surface has a primary substantially flat portion and a raised lip forward thereof.

7. A device according to claim 6 wherein:

from a front extreme of said shelf portion a first lip surface extends upward and rearward within 30 degrees of vertical; and a second lip surface extends rearward and upward from the first lip surface within 30 degrees of horizontal.

8. A device according to claim 7 wherein an at least partially transparent extrusion is secured to at least one of the first and second lip surfaces and defines a signage receiving channel.

9. A device for supporting a plurality of products, said device comprising:

a back portion secured to a support surface in an installed condition and having front and back sides, left and right sides, and upper and lower ends;

a shelf portion hinged to a lower portion of the back portion for articulation between stowed and deployed conditions and having a first surface which is a substantially upper surface in said deployed condition and in close facing or contacting proximity to the back portion front side in said stowed condition; and a signage carrier comprising:

a base from which a pair of front and rear rails depend, the rails having a depending leg portion and a foot portion;

an upstanding web connected to the base; and a signage receiving portion extending forward from the web and having left and right side surfaces and a rim and inward projections from said rim spaced outboard of said left and right side surfaces; and wherein:

the shelf portion includes a first elongate transverse slot receiving the rails; and the signage receiving portion carries a pair of left and right signage cards along said left and right surfaces and retained by the projections.

* * * * *